US009778005B2

(12) United States Patent
Rosales et al.

(10) Patent No.: US 9,778,005 B2
(45) Date of Patent: Oct. 3, 2017

(54) STACKABLE PROJECTILE

(71) Applicant: Defendtex Pty. Ltd., Moorabbin (AU)

(72) Inventors: Rene Rosales, Richlands (AU); Ben Bishop, Richlands (AU)

(73) Assignee: Defendtex Pty. Ltd., Moorabbin (AU)

( * ) Notice: Subject to any disclaimer, the term of this patent is extended or adjusted under 35 U.S.C. 154(b) by 277 days.

(21) Appl. No.: 13/936,982

(22) Filed: Jul. 8, 2013

(65) Prior Publication Data

US 2015/0241186 A1 Aug. 27, 2015

Related U.S. Application Data

(63) Continuation of application No. 12/519,146, filed as application No. PCT/AU2007/001928 on Dec. 14, 2007, now Pat. No. 8,479,654.

(30) Foreign Application Priority Data

Dec. 14, 2006 (AU) ..... 2006907006

(51) Int. Cl.
*F42B 5/03* (2006.01)
*F42B 15/36* (2006.01)
(Continued)

(52) U.S. Cl.
CPC ..... *F42B 15/36* (2013.01); *F41A 19/61* (2013.01); *F42B 5/035* (2013.01); *F42B 5/073* (2013.01);
(Continued)

(58) Field of Classification Search
CPC .. F42B 5/03; F42B 5/035; F42B 5/073; F42B 5/08; F42B 15/36; F42B 5/00; F42B 5/02;
(Continued)

(56) References Cited

U.S. PATENT DOCUMENTS 2,099,993 A * 11/1937 Tauschek ..... F41A 9/06 102/430
3,815,271 A 6/1974 Lynn
(Continued)

FOREIGN PATENT DOCUMENTS

EP 2639543 A1 * 9/2013 ..... F42B 5/035
WO WO 94/20809 9/1994
(Continued)

OTHER PUBLICATIONS

Written Opinion of the International Searching Authority for PCT/AU2007/001928 dated Feb. 2008.*
(Continued)

*Primary Examiner* — James S Bergin
(74) *Attorney, Agent, or Firm* — LeClairRyan, a Professional Corporation

(57) ABSTRACT

The present invention relates to stackable projectiles having a warhead and a propulsion unit. An adaptor enables the warhead to be coupled to propulsion units made of different materials. Furthermore, an adaptor couples different profiles of warheads and propulsion units and allows projectiles to be stacked without need for design modifications. The assembled projectile can be fired electrically or mechanically.

14 Claims, 7 Drawing Sheets

(51) Int. Cl.

| | |
|---|---|
| ***F42B 5/08*** | (2006.01) |
| ***F42B 30/00*** | (2006.01) |
| ***F42C 11/04*** | (2006.01) |
| ***F41A 19/61*** | (2006.01) |
| ***F42B 5/073*** | (2006.01) |

(52) U.S. Cl.
CPC ..... *F42B 5/08* (2013.01); *F42B 30/00* (2013.01); *F42C 11/04* (2013.01)

(58) Field of Classification Search
CPC ..... F42B 14/00; F42B 30/00; F42B 30/08; F41A 19/61; F42C 11/04
USPC ..... 102/438, 439, 517
See application file for complete search history.

(56) References Cited

U.S. PATENT DOCUMENTS

| | | | | |
|---|---|---|---|---|
| 6,722,252 | B1 * | 4/2004 | O'Dwyer | F41A 21/06 89/1.41 |
| 7,194,943 | B2 | 3/2007 | O'Dwyer | |
| 7,373,884 | B2 * | 5/2008 | Haeselich | F42B 5/035 102/217 |
| 7,475,636 | B2 * | 1/2009 | O'Dwyer | F41A 19/62 102/372 |
| 7,600,421 | B1 * | 10/2009 | Hollis | F42B 12/365 102/510 |
| 7,743,705 | B2 | 6/2010 | O'Dwyer | |
| 7,905,182 | B2 * | 3/2011 | Janik | F42B 5/00 102/293 |
| 7,984,675 | B2 | 7/2011 | O'Dwyer | |
| 8,127,685 | B2 | 3/2012 | O'Dwyer | |
| 8,479,654 | B2 * | 7/2013 | Rosales | F42B 5/035 102/430 |
| 8,783,155 | B2 * | 7/2014 | Green | F41A 1/06 102/360 |
| 2004/0231219 | A1 * | 11/2004 | O'Dwyer | F42B 5/03 42/84 |
| 2006/0011090 | A1 * | 1/2006 | Vasel | F41B 11/62 102/512 |

FOREIGN PATENT DOCUMENTS

| | | |
|---|---|---|
| WO | WO 01/90680 | 11/2001 |
| WO | WO 02/097357 | 12/2002 |
| WO | WO 03/006917 | 1/2003 |
| WO | WO 03/089871 | 10/2003 |
| WO | WO 2004/005836 | 1/2004 |
| WO | WO 2004/102108 | 11/2004 |
| WO | WO 2007/082334 | 7/2007 |

OTHER PUBLICATIONS

Metal Storm Limited; PCT/AU2007/001928 filed Dec. 14, 2007; International Search Report; dated Feb. 4, 2008; ISA/AU; 5pp.

* cited by examiner

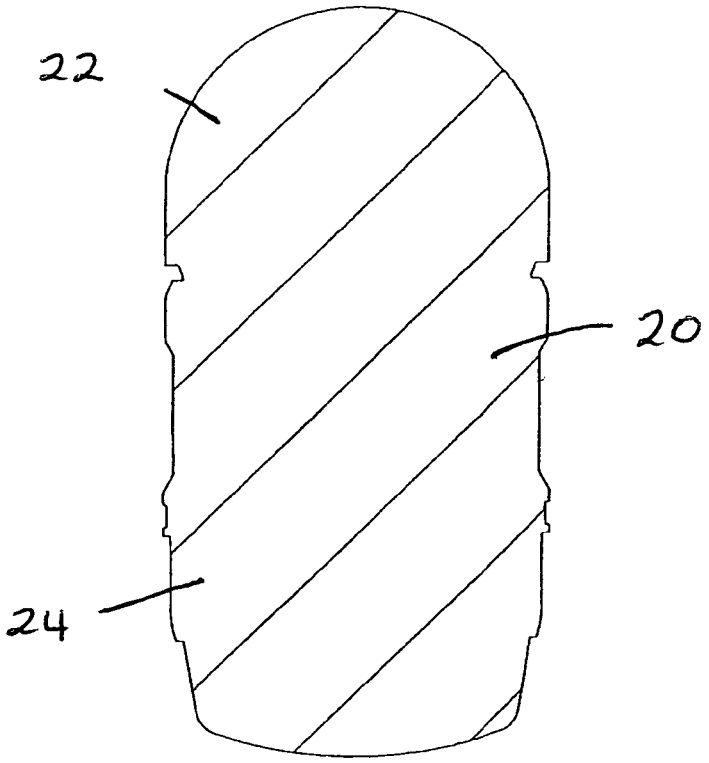
FIG 4
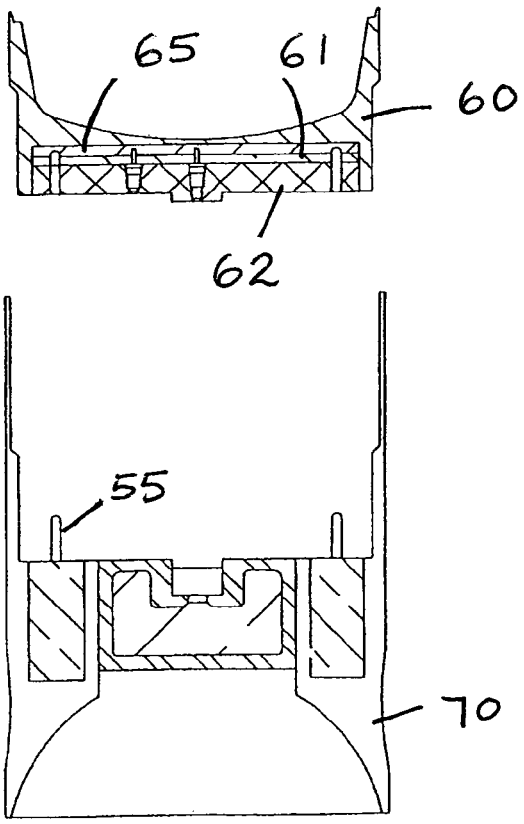

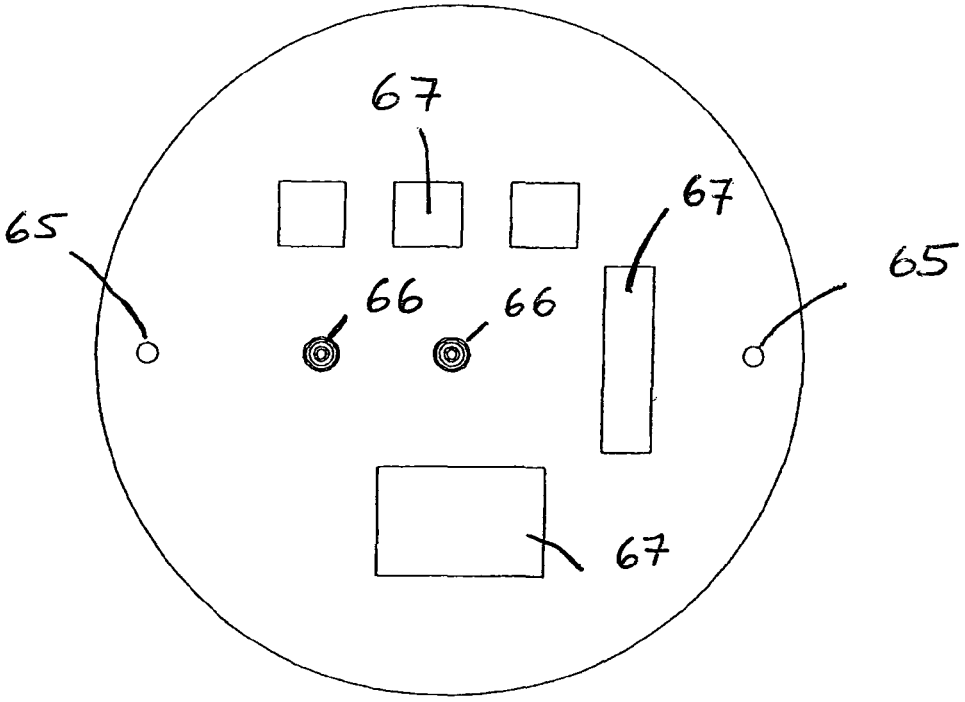
FIG 6
FIG 5
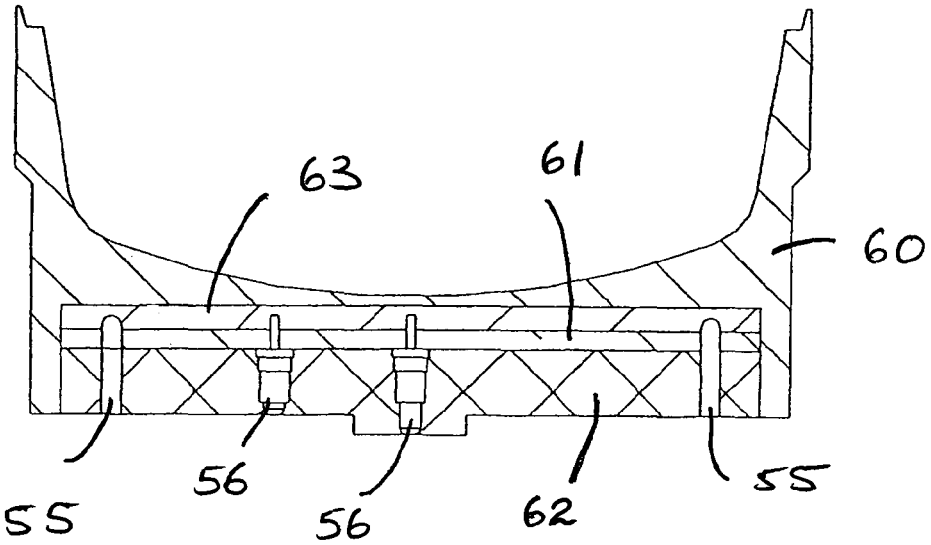

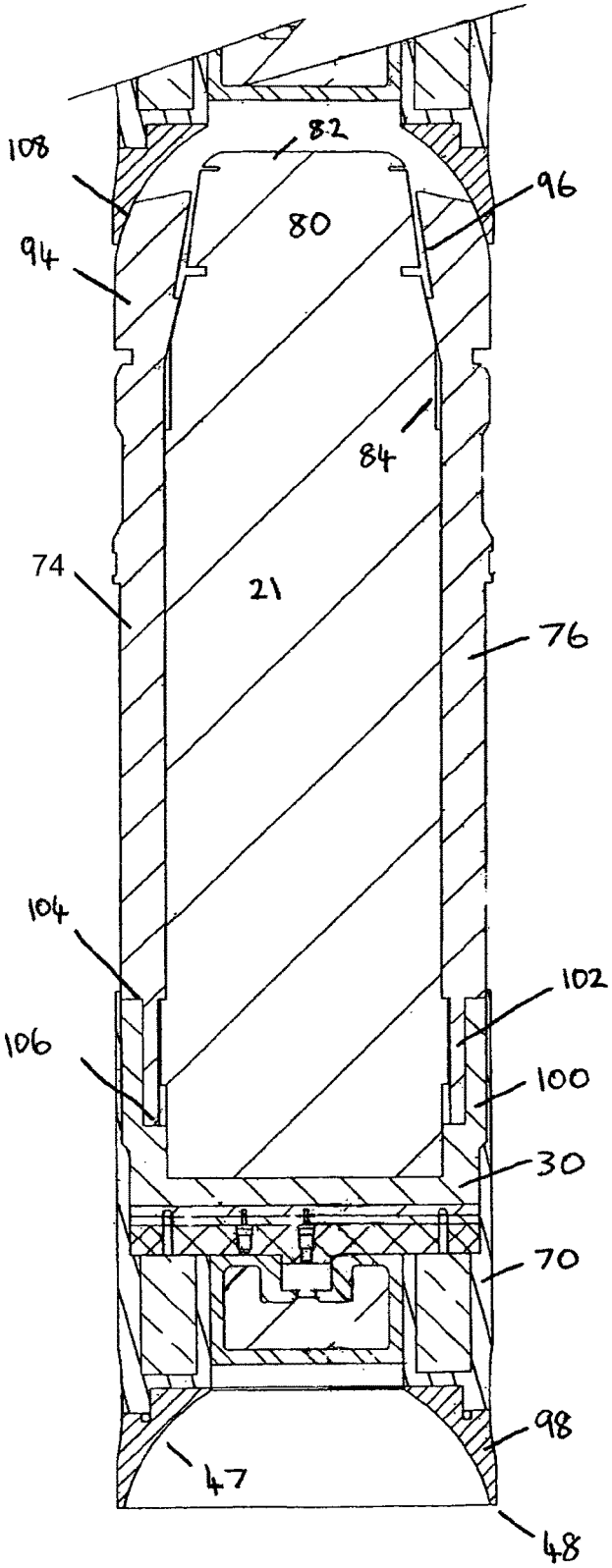
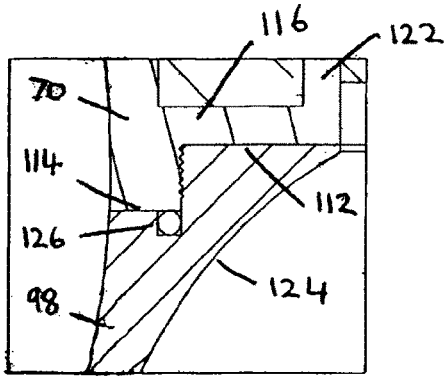
FIG 8B
FIG 8A

STACKABLE PROJECTILE

RELATED APPLICATIONS

This application is a continuation of pending U.S. patent application Ser. No. 12/519,146, filed Dec. 15, 2009, which is a national phase application of International Application No. PCT/AU2007/001928, filed Dec. 14, 2007, which claims priority from Australian Patent Application No. 2006907006, filed Dec. 14, 2006. The disclosure of the above-identified applications is incorporated by reference herein in its entirety.

FIELD OF THE INVENTION

The present invention generally relates to stackable projectiles, and more particularly to an adaptor for coupling to a propulsion unit for a stackable projectile.

BACKGROUND OF THE INVENTION

Stackable projectiles typically comprise a warhead coupled to a propulsion unit. The propulsion unit usually takes the form of a tailpiece containing a propellant burner, a primer and other components, and which is shaped to accommodate the nose of a similar projectile. Such projectiles can be stacked nose to tail in the barrel of a weapon and fired sequentially using a suitable firing mechanism.

A propulsion unit can be crimped or screw threaded amongst other methods onto a warhead in order to couple the two together. Both crimping and screw threading are direct approaches of joining the warhead to the propulsion unit. However, crimping and screw-threading are not suitable if the propulsion unit is made of different materials. For example, if the warhead is made of metal and the propulsion unit is made of plastic.

Furthermore, different manufacturing parties produce different profiles of warheads and propulsion units, so crimping and screw threading may not be the appropriate methods for joining different profiles of warheads and propulsion units. In order to couple the different profiles of warheads to propulsion units, the profile of the propulsion unit is usually redesigned to accommodate the profile of the warhead. Alternatively, the profile of the warhead can be redesigned to accommodate the profile of the propulsion unit. However, redesigning the profile of the warhead or propulsion unit can be time consuming and costly.

SUMMARY OF THE INVENTION

It is an object of the invention to provide for improved coupling between a warhead and a propulsion unit when forming a stackable projectile, or at least to provide an alternative to existing projectiles. Another object of the invention is to provide an improved propulsion unit for stacking projectiles. A further object of the invention is to provide for adapting existing warheads for stacking.

Accordingly, in one aspect, the present invention provides a stackable projectile comprising: a warhead having a head section and a base section; an adaptor having a top surface, a bottom surface and a side surface, wherein the top surface is configured to accommodate the base section of the warhead; and a propulsion unit having a base, and a cylindrical wall extending from the base to form a receptacle, wherein the receptacle is configured to accommodate the adaptor and the base section of the warhead, wherein the side surface of the adaptor is configured to fit into the receptacle, thereby when the projectile is assembled, the top surface of the adaptor is coupled to the base section of the warhead, and the side surface of the adaptor is coupled to the cylindrical wall of the propulsion unit.

In another aspect, the present invention provides a method for assembling a stackable projectile, comprising the steps of: providing a warhead having a head section and a base section; providing a propulsion unit having a base, and a cylindrical wall extending from the base to form a receptacle; providing an adaptor for coupling the warhead to the propulsion unit, wherein the adaptor has a top surface, a bottom surface and a side surface, the top surface of the adaptor is configured to accommodate the base section of the warhead, and the side surface of the adaptor is configured to fit into the receptacle of the propulsion unit; coupling the top surface of the adaptor to the base section of the warhead; and coupling the side surface of the adaptor to the cylindrical wall of the propulsion unit.

In another aspect the present invention provides a stackable projectile comprising: a warhead having a head section and a base section; and a propulsion unit having a base including an interchangeable trailing surface portion having a trailing surface for engaging with a trailing projectile.

BRIEF DESCRIPTION OF THE DRAWINGS

Preferred embodiments according to the present invention will now be described with reference to the Figures, in which:

FIG. 4 shows an alternative projectile prior to assembly,

FIG. 5 shows the alternative adaptor in more detail,

FIG. 6 shows an underlay for an electronic stage,

FIG. 8*a* shows the assembled projectile with another further alternative adapter and stacking adaptor, and FIG. 8*b* shows more detail of the rearward end of the projectile of FIG. 8*a*.

DETAILED DESCRIPTION OF THE INVENTION

It will be appreciated that the invention may be implemented in various ways for a range of stacked projectile weapons and a range of projectile calibers. The embodiments described here are given by way of example only.

Figure 1:
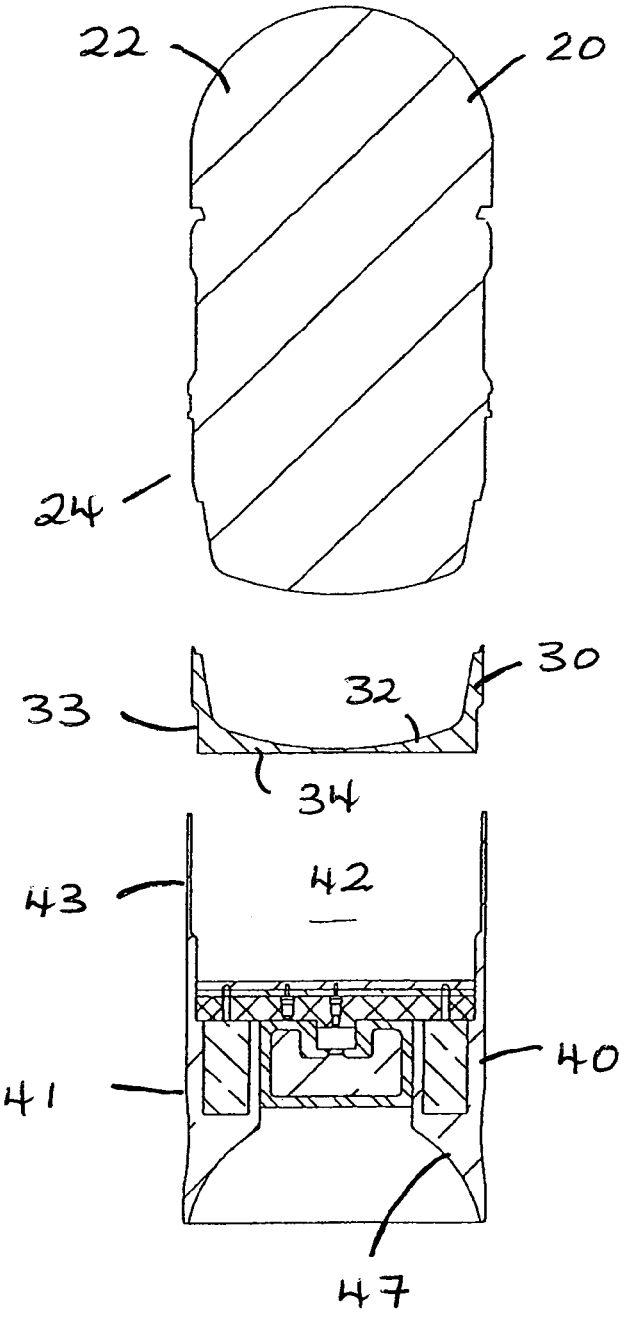
FIG. 1 shows a stackable projectile prior to assembly.
Figure 2:
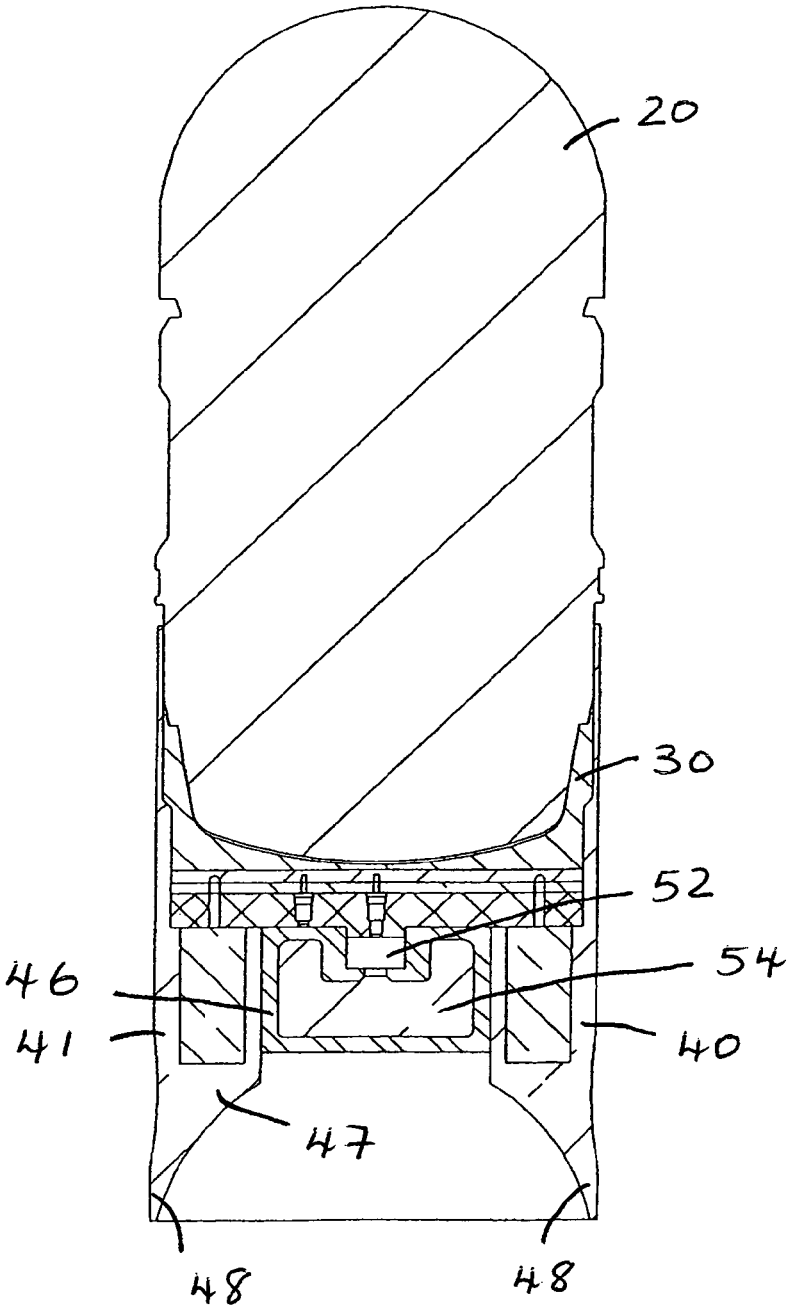
FIG. 2 shows the assembled projectile.

FIGS. 1 and 2 illustrate one embodiment of a stackable projectile comprising a warhead 20, an adaptor 30, and a propulsion unit 40. These parts have generally cylindrical shapes. The warhead 20 has a head or nose section 22 and a base section 24. The warhead is preferably made of metal, metal alloys or other materials of the like. Furthermore, the warhead 20 contains highly explosive energetic materials with a safety fusing mechanism (not shown). Alternatively, the projectile may be filled with inert materials such as sodium bicarbonate, sand, epoxy and other non-explosive materials.

The adaptor 30 includes a top surface 32, a side surface 33 and a bottom surface 34. The top surface 32 is configured to accommodate the base section 24 of the warhead 20. In particular, the top surface 32 is preferably coupled to the base section 24 using adhesives, wherein the top surface 32 provides additional surface area for adhering the warhead 20 to the adaptor 30. The adaptor 30 is typically solid structure and can be made from a range of materials such as plastics, metal, metal alloys, or the like. It may also be coupled to the warhead and/or the propulsion unit by screw threads or press fit structures for example. Other surfaces of the warhead, adaptor and propulsion unit may also be fastened together if required. In a more complex form described below the adaptor may include components which operate with the propulsion unit.

The propulsion unit 40 comprises a base 41, and a cylindrical wall 43 extending from the base to form a receptacle 42, wherein the receptacle 42 is configured to accommodate the adaptor 30 and base section 24 of the warhead 20. In particular, the side surface 33 of the adaptor 30 is configured to fit into the receptacle 42. The side surface 33 of the adaptor 30 can be coupled to the cylindrical wall 43 of the propulsion unit 40 using screw thread or adhesives for example. The propulsion unit 40 can be made from metal materials, plastic materials, or the like. A primer 52 and a propellant 54 can be centrally disposed at the base 41 of the propulsion unit 40. The base 41 may have a high pressure chamber 46 that houses the propellant 54 for stackable munitions.

The base 41 includes a surface 47 which is shaped to accommodate the head section 22 of another warhead so that the projectile can be stacked with other projectiles in the barrel of a weapon. The surface 47 may take a range of shapes depending on the shape of the head section of the trailing projectile, and preferably forms a seal with the head section and/or with the barrel of the weapon. The seal is typically formed by contact of surface 47 with the trailing head section and an outwards deformation of edge portions 48. A seal of this kind acts to reduce the possible effect of ignition gases on the propellant 54 in successive projectiles and also the passage of ignition gases down the barrel when the leading projectile in a stack is fired. The chamber 46 and propellant 54 may take many forms including self-sealed systems which are not dependent on sealing between adjacent projectiles or between projectiles and the barrel. A wide range of sealing systems may be used in the propulsion unit.

Figure 3:
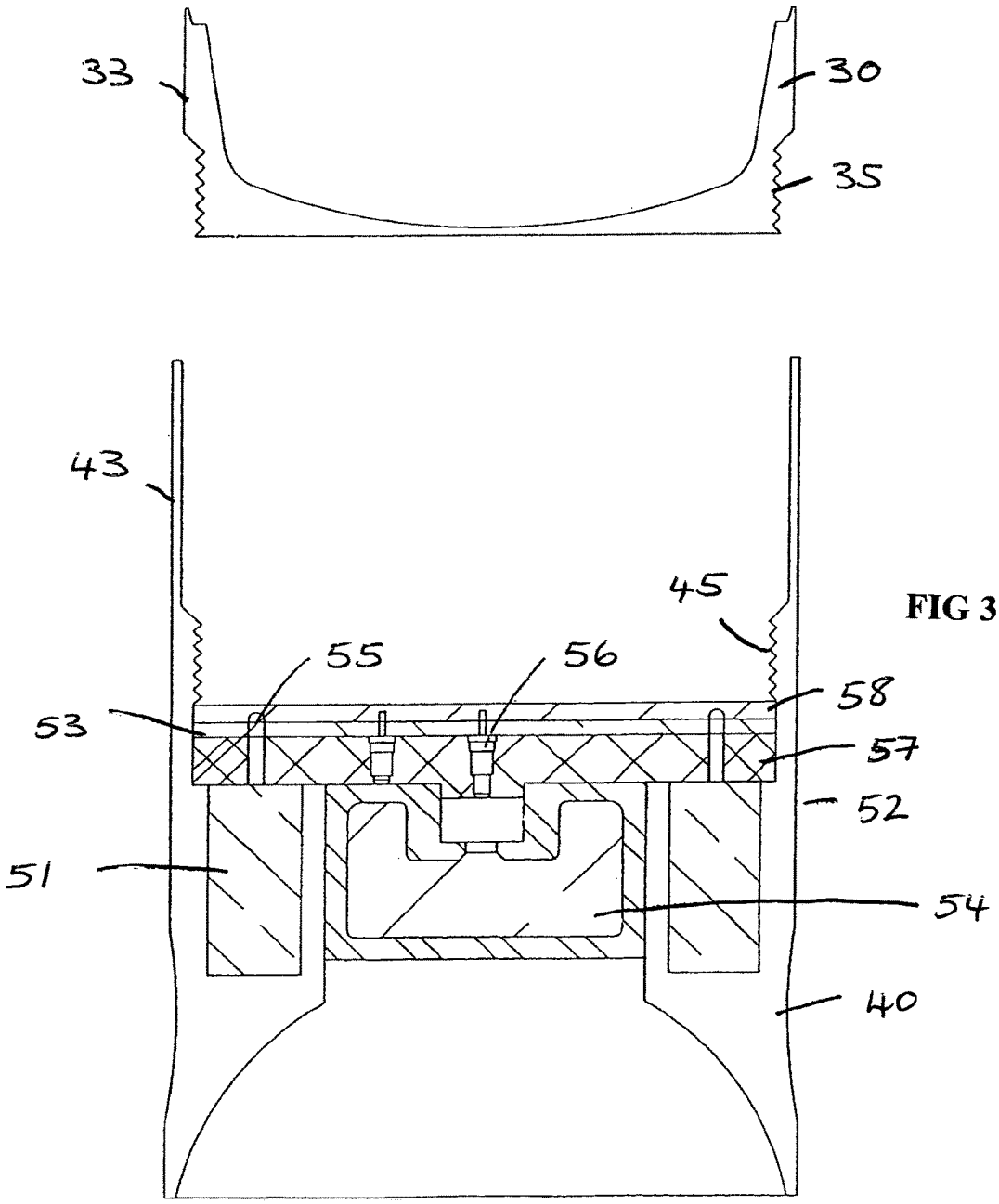
FIG. 3 shows a preferred adaptor and tailpiece in more detail.

FIG. 3 shows more detail of a preferred adaptor 30 and propulsion unit 40. In this example the cylindrical wall 43 of the propulsion unit has a threaded portion 45 within the receptacle 42. The side surface 33 of the adaptor 30 has a corresponding threaded portion 35. These threaded portions engage to retain the adaptor and components of the propulsion unit within the receptacle.

In FIG. 3 the propulsion unit also includes a firing mechanism having an annular inductor 51 and an electronic stage 53 which detect electromagnetic signals from an external firing system. The electronic stage 53 is connected to the inductor by pins 55 and connected to the primer 52 by pins 56. The inductor and the electronic stage form a detector for firing signals and the pins 56 form an interface with electrical contacts between the detector and the primer/propellant. In this example the high pressure chamber 46 is electrically conductive and completes the electrical circuit from one pin 56 through the primer 52 to the second pin 56. The location of pins 56 can be readily varied for different primers 52 and different high pressure chambers 46. For non conductive chambers 46 both pins 56 may be located to contact respective conductors of the primer 52. The electronic stage is typically a PCB provided as a circuit board between an underlay 57 and an overlay 58. The underlay and overlay are typically discs formed from plastics material to support and protect the electronic stage from mechanical load and to hold the pins 55, 56 in place. Signals received by the inductor are delivered to the electronic stage through pins 55, interpreted in relation to the particular projectile, and if appropriate, the primer 52 and/or the propellant 54 are ignited through pins 56 to fire the projectile. If the signal sent to the electronics stage 53 is not appropriate for the particular projectile the primer 52 will not be ignited. In this manner a particular projectile launcher or a particular operator of the projectile launcher can be limited to use with only a particular projectile or particular type of projectile. This also provides for safety against inadvertent firing from e.g. stray electromagnetic (EM) fields. A wide range of firing mechanisms and related structures may be used in the propulsion unit. The PCB could incorporate a sophisticated electronics package to enable projectile to weapon communications before and after firing, electronic fusing and electronic safety features for example.

The primer 52 is seated in a primer pocket which extends into the high pressure chamber 46. The chamber 46 and inductor 51 are concentric and capped by the electronics stage 53. These arrangements reduce the overall length of the propulsion unit for a set volume of propellant and pressure chamber.

The firing and propulsion components of the propulsion unit 40 such as the electronics stage 52, inductor 51 and pressure chamber 46 may be housed in respective chambers in the propulsion unit 40. This arrangement allows for easy assembly. The components may be dropped into position in their respective chambers. Or when necessary, press fit into position or fixed in position with an adhesive where necessary.

The electronics stage 53, inductor 51 or even the high pressure chamber 46 can be selected from a range of such components to vary the safety, authorization or even the propulsion characteristic of the propulsion unit. For example, a higher level of safety is required for high explosive warheads than for kinetic warheads comprising resilient synthetic materials used for crowd control or for sand filled projectiles. Safety is a feature of the propellant, primer and inductor as well as the electronics stage or a combination thereof. The inductor can be selected as a function of the energy required by a particular primer 52 or alternatively, depending on the energy available from the projectile launcher. Furthermore, the electronics stage 53 and/or inductor 51 can be readily substituted where a different level, particularly a higher level, of qualification such as military specification is required or if such specifications change. For example, the electronics stage 53 can be selected to provide for different EM filtering requirements that are currently specified or that may be specified in the future. Similarly the inductor 51 can be selected to operate at a specified level of safety in all currently known and future EM environments.

FIGS. 4 and 5 illustrate an alternative embodiment of the stackable projectile shown in FIGS. 1, 2 and 3. In this example, the adaptor 60 now includes components which were previously part of the propulsion unit, specifically the electronic stage 61 along with the underlay 62 and overlay 63. These components may be fixed together by adhesives or press fit, or simply held in place by combination of the adaptor with the propulsion unit. As before the adaptor may be fastened to the base section 24 of the warhead and also to wall 43 propulsion unit 70 by adhesive, screw thread, press fit structures, for example. The remainder of the propulsion unit 70 and also the warhead 20 are generally unchanged over the previous embodiment.

FIG. 6 shows a typical underlay 57 or 62 in radial rather than axial cross section. Apertures 65 and 66 are provided for pins 55 and 56 respectively. A range of apertures 67 are indicated by way of example, to accommodate projections which may extend from components of the electronic stage 61. The underlay, overlay and electronic stage may take a wide range of different structures depending on the particular projectile and the adaptor which are required.

Figure 7A:
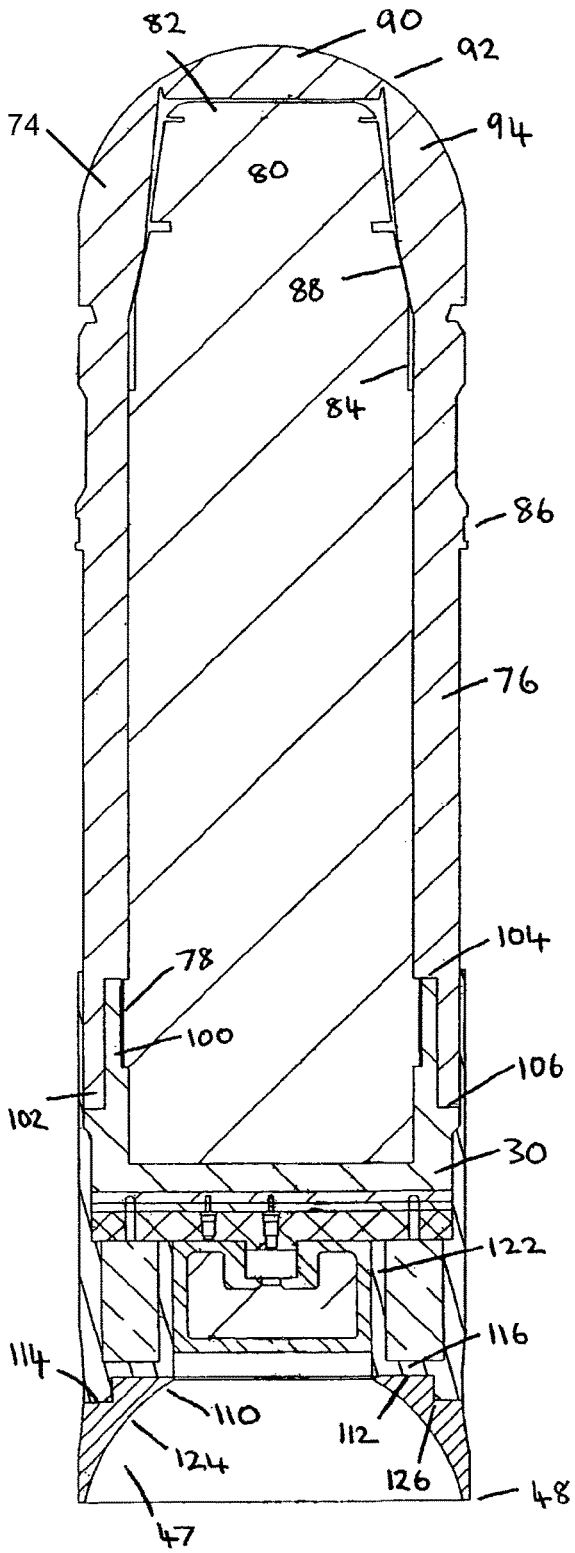
FIG. 7*a* shows the assembled projectile with a further alternative adapter and a stacking adaptor.
Figure 7C:
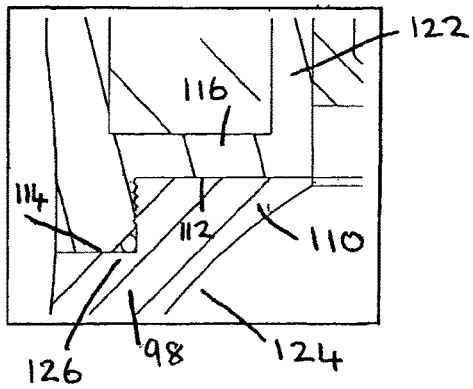
FIG. 7*c* shows more detail of the rearward end of the projectile of FIG. 7*a*.
Figure 7B:
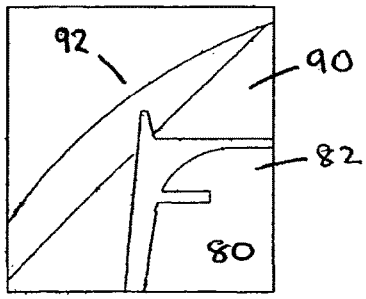
FIG. 7*b* shows more detail of the forward end of the projectile of FIG. 7*a*.

FIGS. 7 and 8 illustrate alternative embodiments of the stackable projectile. The projectile further includes a forward portion 74 surrounding the middle section 21 of the warhead and optionally also the nose section 22. This allows warheads of a smaller caliber to be used with a larger caliber barrel. The illustrated example of these embodiments show a 30 mm high explosive Russian military grenade adapted for stacking in a larger caliber barrel such as a barrel used for 40 mm warheads. The 30 mm grenade includes a driving band 78 at the trailing end of the middle section 21 and mechanical trigger or fuze 80 and 82 on the nose section 22. The leading end of the middle section 21 includes two flats 84 in diametrically opposed positions.

The forward portion 74 is typically solid structure and can be made from a range of materials such as plastics, metal, metal alloys, or the like.

In FIG. 7 the forward portion 74 surrounds the entire nose section 22. Covering the nose section 22 protects against any sensitive parts of nose section 22 from propellant gases from firing a leading projectile. Surface 88 may be provided on the forward portion 74 to engage the non trigger or fuze part of the nose section 22 of the warhead. Forward portion may include a thin wall at 92 and thick end wall at 90 forming a button like end of the forward portion 74. The wall is made sufficiently thin at 92 and shaped with for example an external or internal annular groove so that detonation of the warhead will occur for a predetermined impact velocity. The inside surface of the forward portion is spaced from the trigger or fuze 80 and 82 to allow for some compression of the forward portion 74 caused by axial loads in the stack of projectiles.

FIG. 8 illustrates an embodiment where the forward portion 74 does not surround the entire nose section 22.

FIG. 7 shows the forward portion 74 coupled to the adaptor 30 about the driving band 78. This avoids needing to remove the driving band 78. The coupling may include threads, interference (press) fit, adhesive etc or any combination thereof. FIGS. 7 and 8 show a coupling provided by concentric cylindrical coupling walls 100 and 102. When engaged, the end of the cylindrical coupling wall 100 may abut annular surface 104, the end of the cylindrical coupling wall 102 may abut annular surface 106 or ends of both walls 100 & 102 may be in abutment with their respective annular surfaces 104 & 106. This reduces the force carried by the couplings from the longitudinal compression of the projectiles and reduces undesirable longitudinal compression of the projectile when a lead projectile in the stack is fired.

In FIG. 7 adaptor 30 provides the inner of the two concentric cylindrical walls and in FIG. 8 the adaptor 30 provides the outer concentric cylindrical wall. The orientation selected for a particular application will depend on which coupling requires more surface area: the coupling between top surface 32 and base section 24 or the coupling between side surface 33 and the propulsion unit. This will depend on variables such as the materials of the warhead, adaptor and propulsion unit, the strength of the adhesives available for coupling two respective materials and e.g. the torque applied to the couplings by any driving bands. The strength of each coupling is a function of the strength of the coupling selected eg the type of adhesive, torque and the surface area of the coupling. The surface area of eg the coupling with concentric cylindrical walls 100 & 102 is a function of namely, the longitudinal length of the walls 100 & 102 and the radius of the coupling surface.

Other coupling arrangements may be used as required to suit the particular adaptor 30 and forward portion 74 required for a particular warhead. For example, a forward portion for a 37 mm warhead fired from a 40 mm barrel may not have sufficient wall thickness for certain wall materials to provide a coupling with concentric cylindrical walls which is strong enough to withstand the very high forces exerted on the projectile during firing.

FIG. 8 shows the forward portion 74 coupled to the adaptor 30 about the driving band 78. The forward portion 74 may be integral with the adaptor 30 for example where the driving band 78 is removed. When the adaptor 30 and forward portion 74 are integral, leading end 94 of the forward portion 74 may be mechanically deformed to engage the nose section 22 of the war head. Alternatively, the forward portion 74 may include two or more separate parts, not shown, for example two separate parts may comprise a cylindrical portion 76 and a separate leading end 94. Depending on the type of warhead, the leading end 94 includes a suitable rebate such as counter bore 96 to avoid the leading end 94 contacting any mechanical trigger or fuzes of the warhead. Fore surface 108 of leading end 94 engages with surface 47 of the propulsion unit of a leading projectile. The longitudinal forces applied to a stack of projectiles during eg firing of a lead projectile must be carried through the stack. This force may be carried by the warhead, a cylindrical portion 76 of the forward portion or a predetermined distribution between the two. The cross section 94 of the leading end, cylindrical portion 76 and engagement there between is such that longitudinal force applied to the fore surface 108 by surface 47 of a leading projectile is distributed to the warhead and/or cylindrical portion 76 as predetermined. Surface 47 can also suitably be modified for the predetermined application of forces. Determining the force distribution and hence the dimensions of the forward portion 74 and the surface 47 is a function of the warhead shape and internal structure and the barrel of the projectile launcher.

FIGS. 7 & 8 show surface 47 on a stacking adaptor 98 separable from the remainder of the propulsion unit 70. The separable stacking adaptor 98 provides an improvement over the prior art similar to adaptor 30. The surface 47 can be readily changed. The outer cylindrical surface of the stacking adaptor can also be modified. Changes can readily be made to accommodate different shaped warheads, different pay loads for a given warhead, different propulsion charges and different barrel bore diameters. Without the difficulty and cost of redesigning the entire propulsion unit.

The coupling of the stacking adaptor 98 to the remainder of the propulsion unit 70 is preferably a sealing coupling so that propulsion gases do not escape forward up the barrel with the consequent loss of projectile velocity and will still force edge portion 48 into sealing contact with the bore of the barrel as designed. In the illustrated example of FIGS. 7 & 8 the stacking adaptor 98 is threaded to the remainder of the propulsion unit 70 preferably with adhesive and sealing means such as an o-ring or fluid sealing compound. Other types of coupling may be used. Similarly, forces applied through the stack act through the coupling with the stacking adaptor 98.

The type of coupling and dimensions and materials of the coupling which can provide sufficient sealing will depend on the relative movement of the stacking adaptor 98 and the remainder of the propulsion unit 70 adjacent the coupling. This will determine, for example, the location of any sealing rings. Relative movement near the coupling can occur from expansion of the high pressure chamber 46 as well as gases acting directly on the surfaces of the stacking adaptor 98 and the remainder of the propulsion unit 70. Movement is a function of the forces applied as well as the relative geometries. Where the high pressure chamber 46 is substantially rigid and hence undergoes little radial expansion, only forces from the expanding gases need be considered for design of the sealing coupling.

In the example in FIG. 7 expanding gases act on wall 122 and surface 47. Pressure on wall 122 may cause annular wall 116 to pivot upwards and tend to break any sealing on annular surface 112. To maintain any such seal the stacking adaptor 98 may include a sufficiently thin lip seal 110 or may include a pivot 124 which provides greater pivoting of forward part 110 of the stacking adaptor 98 than pivoting of the wall 116. Pivot 124 also allows for some outward pivoting of the rearward part of the stacking adaptor 98 for radial movement of end portion 48 into engagement with the bore of the barrel. At the same time, any sealing at annular surface 114 is enhanced or maintained. In one embodiment of the invention, annular groove and sealing ring 126 may be located on a corner of the stacking adaptor 98 adjacent pivot 124. The annular groove and sealing ring 126 may alternatively be provided on the remainder of the propulsion unit 70 as show in FIG. 7*c*. The annular groove and sealing ring 126 may alternatively or also be provided for any sealing at either or both of surfaces 112 and 114 as shown in FIG. 8*b*.

Annular surfaces 112 and 114 may be angled relative to the longitudinal axis, not shown, of the projectile to provide a frusto-conical annular surface if required to provide sufficient sealing for a given geometry and gas pressure. Angled surfaces provide better seals as described in published PCT patent application WO2003/089871 by the present applicant.

Some warheads require either or both spin speed and spin count to arm the warhead. The leading end of the cylindrical portion 76 may include one or more driving bands 86 and keys to engage with the flats 84. The keys and flats 84 provide rotational coupling between the warheads and the driving band 86 whereby relative rotation there between is prevented. Rotational coupling is provided by the coupling between the adapter 30 and the base section 24 as described above. The coupling between the adapter 30 and the forward portion 74 may also be keyed to provide rotational coupling.

Stacked projectile launchers such those described in the applicant's prior patents WO94/20809A1 and more recently in WO2003/089871A1 have multiple firing positions along the length of the barrel. Firing of a lead projectile in a stack exerts longitudinal forces, along the length of the barrel, to the remaining projectiles. When the longitudinal force is removed as the pressure in the barrel from the lead projectile drops the remaining projectiles may separate and move out of alignment with their respective initiation mechanisms. To prevent such misalignment projectiles are preferably fastened together. Preferred methods include screw fastening and clip fastening. Fastening projectiles together allows a sliding fit between projectiles and the bore of the barrel of a launcher whereby the projectiles can be individually loaded directly into the barrel in the field over the life span of the launcher and throughout a practical service interval. To fasten adjoining projectiles, the forward portion 74 and preferably the leading end 94 of the examples of the embodiments of FIGS. 7 and 8 may include an annular groove for receiving clips of a leading projectile as described in published patent specification WO2007/082334A1 by the applicant.

As discussed above, the adaptor couples different profiles of warheads and propulsion units without any need for design modifications. Furthermore, the adaptor allows the warhead to be coupled to propulsion units made of different materials. This facilitates the testing of the warhead by coupling it to different propulsion units without any need of redesigning the profile of the warhead. In addition, different types of propulsion units can be coupled to the projectile to enable the projectile to be fired mechanically or electronically. Also, the current production process need not be modified too drastically for producing stackable projectiles. Similarly the interchangeable trailing surface portion of the propulsion unit provides for the convenient and low cost stacking of existing known and yet to be developed warheads and particularly warheads not originally designed for stacking.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the spirit and scope of the present invention. Accordingly, the scope of the present invention is described by the appended claims and is supported by the foregoing description.

What is claimed is:

1. A stackable projectile including:

a warhead having a head section and a base section;

an adaptor having a top surface, a bottom surface and a side surface, wherein the top surface is configured to accommodate the base section of the warhead with the top surface in contact with substantially the entire base section of the warhead; and a propulsion unit having a base and a cylindrical wall extending from the base to form a receptacle, wherein the receptacle is configured to accommodate the adaptor and the base section of the warhead, wherein the side surface of the adaptor is configured to fit into the receptacle, and wherein the propulsion unit is shaped to accommodate the warhead of a trailing projectile in a stack, wherein when the projectile is assembled, the top surface of the adaptor is coupled to the base section of the projectile, and the side surface of the adaptor is coupled to the cylindrical wall of the propulsion unit.

2. The projectile of claim 1, wherein the top surface of the adaptor is coupled to the base section of the warhead using adhesives.

3. The projectile of claim 1, wherein the side surface of the adaptor is coupled to the cylindrical wall of the propulsion unit using screw threads.

4. The projectile of claim 1 further including an electronic detector located in either the propulsion unit or the adaptor, for detecting firing signals from an external firing system.

5. The projectile of claim 1, wherein the adaptor is made of metal, metal alloys or plastics.

6. An adaptor for coupling a warhead to a propulsion unit to form a stackable projectile, comprising:

an adaptor having a top surface, a bottom surface and a side surface, wherein the top surface is configured for connection to a base section of the warhead with the top surface in contact with substantially the entire base section of the warhead and the side surface is configured for connection to a wall portion of the propulsion unit; and a detector for signals received from an external firing system and an interface for connecting the detector to a primer or propellant in the propulsion unit.

7. An adaptor according to claim 6 having a substantially solid body of plastics or metallic material, and wherein the top surface is substantially concave, the bottom surface is substantially flat, and the side surface is substantially cylindrical.

8. An adaptor according to claim 7 wherein the side surface includes screw threads for connection to the propulsion unit.

9. An adaptor according to claim 7 wherein the detector includes a circuit board located between plastic supports and the interface includes electrical contacts which extend through the supports.

10. A method for assembling a stackable projectile, comprising the steps of:

providing a warhead having a head section and a base section;

providing a propulsion unit having a base, and a cylindrical wall extending from the base to form a receptacle, wherein the base is shaped to accommodate the head section of a warhead in a trailing projectile in a stack;

providing an adaptor for coupling the warhead to the propulsion unit, wherein the adaptor has a top surface, a bottom surface and a side surface, wherein the top surface of the adaptor is configured to accommodate the base section of the warhead with the top surface in contact with substantially the entire base section of the warhead, and the side surface of the adaptor is configured to fit into the receptacle of the propulsion unit;

coupling the top surface of the adaptor to the base section of the warhead;

and coupling the side surface of the adaptor to the cylindrical wall of the propulsion unit.

11. The method of claim 10, wherein the step of coupling the top surface of the adaptor to the base section of the projectile further comprises using adhesives.

12. The method of claim 10, wherein the step of coupling the side surface of the adaptor to the cylindrical wall of the propulsion unit further comprises using screw threads.

13. The method of claim 10, wherein the adaptor is made of metal, metal alloys or plastics.

14. The method of claim 10, wherein the propulsion unit is made of metal, metal alloys or plastics.

* * * * *